US005310514A

United States Patent [19]

Ruzek et al.

[11] Patent Number: 5,310,514

[45] Date of Patent: May 10, 1994

[54] PROCESS AND SPINNING DEVICE FOR MAKING MICROFILAMENTS

[75] Inventors: Ivo Ruzek, Kaiserslautern; Walter Bruckner, Wienhausen, both of Fed. Rep. of Germany

[73] Assignee: Corovin GmbH, Peine, Fed. Rep. of Germany

[21] Appl. No.: 862,570

[22] PCT Filed: Dec. 3, 1990

[86] PCT No.: PCT/DE90/00941

§ 371 Date: Jun. 19, 1992

§ 102(e) Date: Jun. 19, 1992

[87] PCT Pub. No.: WO91/09162

PCT Pub. Date: Jun. 27, 1991

[30] Foreign Application Priority Data

Dec. 19, 1989 [DE] Fed. Rep. of Germany ..... 3941824

[51] Int. Cl.[5] ..... D01D 5/084; D02G 1/00

[52] U.S. Cl. ..... 264/103; 264/211.12; 264/211.15; 264/211.17

[58] Field of Search ..... 264/103, 115, 121, 211.12, 264/211.14, 211.15, 211.17, 517, 518, 555; 425/72.2, 83.1, 326.1, 378.2, 379.1, 382.2, 461, 463, 464

[56] References Cited

U.S. PATENT DOCUMENTS

| | | | |
|---|---|---|---|
| 3,954,361 | 5/1976 | Page | 425/72.2 |
| 4,181,697 | 1/1980 | Koschinek et al. | 264/211.14 |
| 4,578,134 | 3/1986 | Hartmann et al. | 264/211.15 X |

FOREIGN PATENT DOCUMENTS

| | | | |
|---|---|---|---|
| 0244217 | 11/1987 | European Pat. Off. . | |
| 0245011 | 11/1987 | European Pat. Off. . | |
| 0334604 | 9/1989 | European Pat. Off. . | |
| 2514874 | 10/1976 | Fed. Rep. of Germany . | |
| 60-59119 | 4/1985 | Japan | 264/211.17 |
| 2135629 | 9/1984 | United Kingdom . | |

*Primary Examiner*—Leo B. Tentoni

*Attorney, Agent, or Firm*—Burns, Doane, Swecker & Mathis

[57] ABSTRACT

An improved process and apparatus are provided for producing fine microfilaments of a melt-spinnable polymeric material having a silk-like character. The molten polymeric material is melt extruded through a plurality of extrusion orifices, is passed from the extrusion orifices while surrounded by a stream of headed air that surrounds and flows parallel with the molten polymeric material, is passed through a solidification zone wherein cooling air is transversely blown to contact the same, and a pulling force is exerted on the resulting solidified microfilamentary material which is applied below the solidification zone so a to accomplish substantial drawing of the polymeric material intermediate the extrusion orifices and its transformation in to a solidified microfilamentary material. The formation at a high rate of 4,000 to 6,000 meters per minute of quality fine microfilaments of less than 1 dtex per filament (e.g., 0.33 dtex) is made possible. Preferably, the stream of heated air that surrounds the molten polymeric material immediately after the melt extrusion is provided at a temperature that approximates the temperature of the molten filamentary material.

10 Claims, 2 Drawing Sheets

PROCESS AND SPINNING DEVICE FOR MAKING MICROFILAMENTS

BACKGROUND OF THE INVENTION

The invention relates to a process for making microfilaments and in addition, the invention is also concerned with a spinning device for making microfilaments.

Synthetic filaments having a single titer of less than 1 dtex are called microfilaments (the term 1 dtex means that 10 km of the thread or filament weighs 1 gram). The microfilaments have, therefore, a very small diameter and are being twisted into microfilament yarns in a known manner. These microfilament yarns can be woven or knitted in order to produce a textile. Due to the single titer of less than 1 dtex, the textiles are distinguished by a very soft touch and an elegant drape so that they have a silk-like character and can join the fashion trend of silk textiles.

Microfilaments are produced by drawing the microfilament at high drawing speeds from a spinning aperture of a spinning nozzle supplied with molten material and drawing it and taking it up on a roll after passing it through an area through which cooling air has been transversely blown. After that, a multitude of microfilaments are twisted to a microfilament yarn from which the desired textile can be produced by weaving.

It is also known to produce spun bond fabric from the microfilaments by drawing the filaments leaving spinning nozzles under the effect of an injector after passing through an area through which cooling air has been transversely blown and depositing them on a constantly moving receiving conveyor Such spun bond fabrics made of microfilaments are also included in the invention. The microfilaments produced from synthetic polymers have a filament diameter, depending on the synthetic polymer used, below 12 μm in polypropylene and below 11 μm in polyamide or below 10 μm in polyester. The mircofilament yarns produced therefrom, which are being offered mostly as polyamide and polyester yarns, as a rule have a single titer which falls only insignificantly below 1 dtex.

As mentioned above, the microfilament yarns and textile products are similar to the fashionably preferred natural silk due to their soft feel. But the textile yarns made of microfilaments have an additional advantage due to the density of the flat structure. Textile fabrics made of microfilament yarns can be woven so densely that they are in their diffusion characteristics similar to semipermeable diaphragms. These flat structures breathe, i.e. they allow easy passage of gases and also vapors, such as water vapor, although at the same time it is very hard to wet them. This low wettability is due to the small filament diameter and the unfavorable angle formed thereby between two filament surfaces.

The advantageous characteristics of the textiles made of filament yarns and also the spun bond fabrics made therefrom can be traced to the relatively small diameter of the microfilaments which are being produced in the manner described further above according to the common "quick spinning process" and are being combined as a rule into "POY-yarns" (POY=partially oriented yarn). The molten polymer material is extruded by the spinning nozzle, cooled underneath the spinning nozzle by an airstream and drawn at high speed—usually about 6,000 m/min.

In order to further increase the silk-like character of the products produced from the microfilaments (textile or spun bond fabric) and to further improve the described advantages even more, commercial operations strive to reduce the diameter of the microfilaments during their production to a single titer of substantially below 1 dtex. Under the usual practical assumption that one should maintain a like total titer of the microfilament yarn also with finer microfilaments, the number of microfilaments in the yarn or the number of nozzle bores per microfilament yarn must increase proportionally to the reduction of the single titer in dtex, since for the production of a microfilament yarn with the same diameter several times the number of microfilaments are needed. In order to obtain the smaller diameters of the microfilaments, it is necessary to reduce the stream of the mass through the unchanged nozzle bore (spinning aperture).

When a process for the manufacture of microfilaments with smaller diameters is commercially realized, it must be also considered, however, that the filament surface at the same volume is conversely proportional to the third power of the filament diameter. For example, if the single titer is halved, then the thinner filament has an eight-fold surface area.

The larger surface area must be seen, however, in connection with the cooling of the microfilament. The extension of the microfilament fundamentally presupposes a certain temperature, and if the cooling is too strong, the danger exists that the microfilament becomes brittle and tears, especially at the usually high drawing speeds of 6,000 m/min.

When the cooling is too fast, an under-cooled skin will be formed on the surface area of the microfilament. This skin is responsible for a breaking of the filaments because the skin is already stiff while the inner mass, which is surrounded by the skin, is still in the extendable condition.

Only by considerably reducing the drawing speed, and at the same time correspondingly decreasing the stream of the molten material through the spinning nozzle, is a remedy here possible. In the other case, when the stream of the mass stays constant, reduction of the drawing speed would have the result that the filaments could not be produced with the desired small diameter.

The corresponding necessary reduction of the drawing speed leads to values of about 2,000 m/min (as compared to the usual value of 6,000 m/min). In connection with the correspondingly reduced stream of the mass, however, a considerably reduced performance of the spinning device results, which is economically not feasible. Since, when realizing a correspondingly dimensioned spinning device with the spinning conditions to be considered, one usually goes as far as to a just acceptable borderline regarding tearing of the filament, the quality of the microfilamentary yarn is additionally affected, not to mention that the economy of a corresponding spinning device suffers so that—in comparison with filaments with larger diameters and with increased drawing speed—fewer yarns can be produced per time unit.

A process for making filaments is known from EP-A-0 244 217 which addresses the problems of the handling of filaments which have been freshly drawn at high drawing speeds from a spinning nozzle and extended. A cylindrical pressure chamber in which the filaments are received immediately after they have been drawn from the spinning aperture is arranged directly underneath the spinning aperture of the spinning nozzle.

Within the pressure chamber there is concentrically arranged a cylindrical sieve, an the pressure chamber is supplied from the outside under pressure with warm air and the warm air is pressed through the cylindrical sieve in which the filaments freshly extruded from the spinning nozzle are drawn. Supply of the warm air takes place in a direction which is predominantly transverse toward the drawing direction of the filaments, whereby the filaments are subjected to a strain within the pressure chamber or within the cylindrical sieve. Also, in the cylindrical sieve turbulences necessarily take place which represent an additional strain for the freshly drawn filaments.

The direction of the warm air runs parallel to the direction of the filaments only subsequently to the pressure chamber, which opens into an exit pipe. This means that the filaments can only be enveloped jacket-like by the warm air after they have left the exit pipe connected below the pressure space. The known method is not suited for the manufacture of microfilaments, i.e. of filaments having a single titer of less than 1 dtex, since the mentioned stresses within the pressure chamber or within the cylindrical sieve, i.e. in an area which is connected directly to the exit opening of the spinning aperture, are too high. Besides, cooling air is not blown transversely against the filaments in a cooling area, but parallel to the direction of the filaments.

EP-A-O 245 011 further shows a similar process for the production of filaments in which the filaments are drawn at high drawing speed through a spinning aperture from a spinning nozzle fed by molten material after passing through a cooling area and are extended. Here, too, a chamber with a cylindrical sieve is connected directly to the spinning aperture, by which sieve warm air under pressure is provided transversely in the direction of the filaments. Only after leaving the named chamber, the warm air supplied runs in a direction parallel to the filaments. Thus, for the area directly att he exit opening of the spinning aperture, The disadvantages mentioned above apply when producing microfilaments with a very small diameter.

It is the object of the invention to provide a process which makes possible the production of microfilaments with very small diameters without lowering the economy and quality. In addition, the invention provides a spinning device which allows economical production of microfilaments with small diameters.

SUMMARY OF THE INVENTION

It has been found that in a process for producing microfilaments that are useful in the production of textile or spun bond fabrics having a silk-like character comprising:

(a) melt extruding a molten melt-spinnable polymeric material downwardly through a plurality extrusion orifices, (b) passing the resulting molten melt-spinnable polymeric material in the direction of its length through a solidification zone having an entrance end and an exit end wherein cooling air is transversely blown in contact with the molten polymeric material and it is transformed into a solidified microfilamentary material of less than 1 dtex per filament, and (c) exerting a pulling force on said solidified microfilamentary material after it leaves the exit end of the solidification zone so as to accomplish substantial drawing of the molten melt-spinnable polymeric material intermediate said extrusion orifices and its transformation into a solidified microfilamentary material of less than 1 dtex per filament;

that improved results are achieved by surrounding the resulting molten melt-spinnable polymeric material as it passes from the extrusion orifices to the entrance end of the solidification zone with a stream of heated air that flows parallel to the direction of movement of the molten polymeric material.

DESCRIPTION OF PREFERRED EMBODIMENTS

Figure 1:
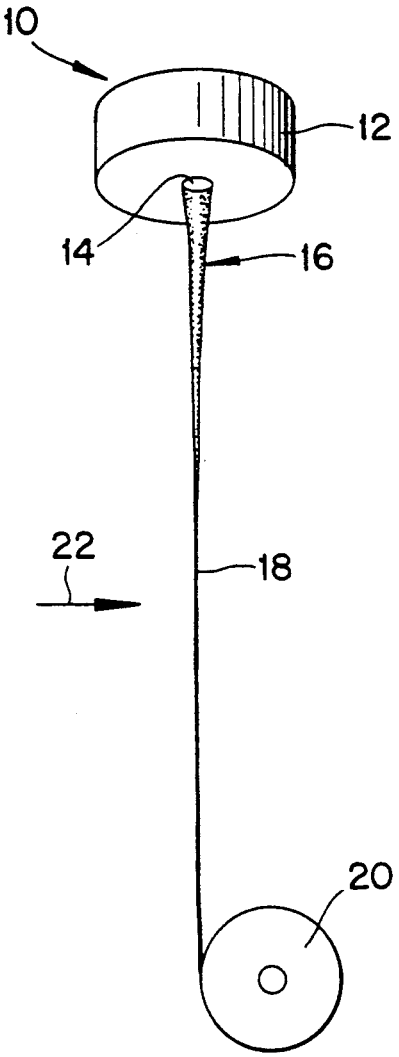
Fig. 1 PRIOR ART
FIG. 1 is a schematic representation of a known spinning device in accordance with the prior art wherein drawing of the as-spun melt-extruded filamentary material is accomplished by means of a pulling force created by a roll.

The invention proposes in a novel manner that the microfilaments immediately after exiting the spinning aperture (i.e., spinning orifice) are being accompanied by a downwardly directed stream of hot air. The extruded filament is thus being embedded in a warm air stream after exiting the spinning aperture, which air stream preferably encloses the filament like a jacket. Due to the envelopment with hot air, the negative influence of the large surface area of the microfilaments, which lead to a fast cooling, is compensated for. In this manner, a too fast cooling of the filaments—due to the significantly higher specific surface area—is prevented. A significant advantage of the invention consists thus in that the filament drawing can take place without problems even at the usual high speeds of 4,000–6,000 m/min.

Due to the high drawing speed it is, therefore, also possible to improve the extrusion of the molten material even with extremely fine microfilaments, whereby the economy of the process of the invention is assured.

At the same time, the tendency of the filament to break is considerably reduced and, additionally, the evenness of the filament diameters over the whole nozzle boring is improved. The microfilament yarns produced according to the process of the invention thus have a noticeably better quality, and the disadvantages described hereinabove are eliminated.

The protective jacket of hot air protects the filament just extruded and formed from cooling too fast immediately after leaving the spinning aperture of the spinning nozzle. Thus, no quickly cooled outer skin of the filament can form which, without the inventive measures, would be damaged by tears and lead to a break of the filament due to the tangential stress brought about by the quick filament drawing.

Rather, the invention takes care that the filament is cooled slowly so that a—if looked at radially—even structure is formed. In that way, the very fine microfilament with small diameter also can be optimally extended (i.e., drawn). In addition, differences between the single filaments of a multifilament-spinning nozzle having a plurality of extrusion orifices are largely suppressed, which leads to a distinct quality improvement.

Since the cooling of the microfilament in the invention does not take place suddenly, but continuously, the danger is removed that at a too fast cooling an undercooled skin forms at the surface area of the filament, which skin is responsible for possible breaks in the filament.

By using the inventive process or the inventive spinning device, cooling of the microfilament is controlled so that the danger that microfilaments with different diameters are formed is avoided. True, in the prior art such possible deviations in the diameters are only small, nonetheless they are noticeable, for example when dyeing the mircofilaments or textiles, the dye is absorbed differently by the different microfilaments having different diameters. Thus, the uniform dyeing of the product intended to be a high-quality textile suffers.

In a preferred embodiment of the invention, known polymers which are spinnable from a molten material were used in the process for the production of microfilaments with very small diameters. Especially polyolefines, particularly polypropylene, as well as polyester and polyamide 6 and 6, 6 are spinnable according to the process of the invention.

Known bi-component nozzles can be used in an advantageous manner, making sure that the outer part of the combined spinning nozzle is changed in such a way that an even distribution of the hot air over all bores is assured. Additionally, the outer bores of the combined nozzle must be adjusted to the air stream.

Such bi-component nozzles have a jacket-core arrangement, only the core nozzle being used for the spinning of the molten polymer material and the hot air stream being produced at the jacket nozzle.

The spinning conditions regarding the molten polymeric material can essentially be maintained in the invention the same way as they are adjusted at the spinning of a usual spinning device. The air temperatures in the outer part of the spinning nozzle (bi-component nozzle) depend upon the melting temperature, the temperature difference of both components not exceeding ±10° C. in a preferred embodiment of the invention. Optimally, the temperatures of both components, molten material and air, correspond to each other.

The amount of hot air is adjusted in a simple manner, a minimum adjustment being necessary in order to make certain that a clean free stream is formed on each spinning aperture at least just below the spinning nozzle.

After passing through a path of about 100 to 500 mm underneath the spinning nozzle, the microfilaments can be cooled stronger by a transverse blowing, the usual blowing shafts being useful for this purpose.

Next to the mechanical drawing devices in the form of a roll which are suitable for producing microfilament yarns from microfilaments, aerodynamical drawing devices in form of an injector can also be used in a suitable way in the context of the invention, so that a spun bond fabric can also be formed in a known manner from the microfilaments formed according to the invention.

Other suitable embodiments and advantageous developments of the invention can be seen from the dependent claims, the specification and the drawing.

The spinning device designated as a whole by reference numeral 10 in FIG. 1 is known. It has a spinning nozzle 12 with a spinning aperture 14 through which molten material 16 leaves and is extended to a microfilament 18. A rotating roll 20 serves as drawing arrangement, on which roll the microfilaments 18 are wound. For reasons of better clarity, the representation according to FIG. 1 shows only the case of a single microfilament. In practical application, when a multitude of microfilaments are being produced, spinning nozzle 12 has a corresponding number of spinning apertures 14.

When leaving spinning aperture 14, molten material 16 has a temperature of about 280° C. Arrow 22 indicates a transverse blowing with cooling air, and microfilament 18 cools so much that it has a temperature of about 60° C. on the bottom of the roll.

The extension of microfilament 18, therefore, is effected by the roll whose rotation speed is decisive for the drawing speed. A usual value of the drawing speed in FIG. 1 is about 4000 to 6000 m/min.

Figure 2:
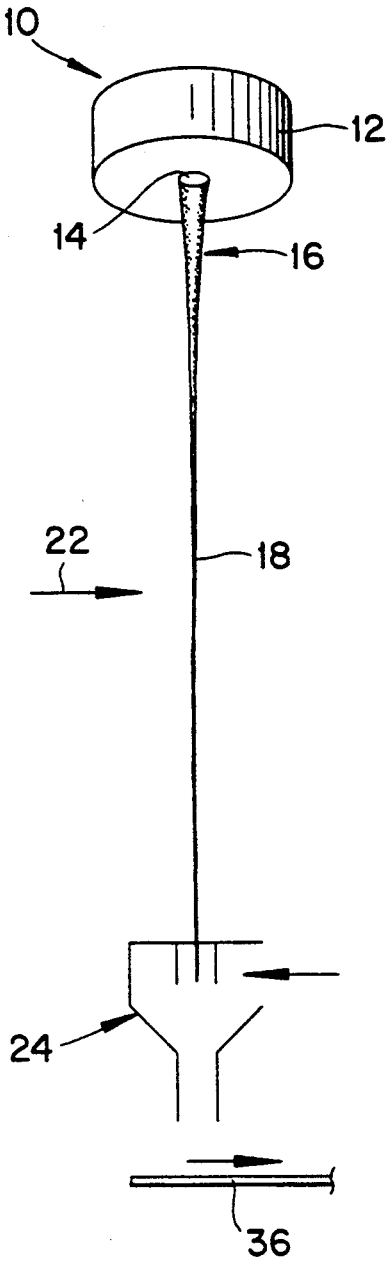
Fig. 2 PRIOR ART
FIG. 2 is a schematic representation of a known spinning device in accordance with the prior art wherein drawing of the as-spun melt-extruded filamentary material is accomplished aerodynamically.

While FIG. 1 clearly illustrates a spinning device for the production of microfilament yarns from which a textile can be woven or knitted, FIG. 2 depicts a known spinning device for the production of spun bond fabrics. Here, the drawing arrangement is built aerodynamically and formed by an injector 24. The microfilaments are deposited on a laterally moving receiving conveyor 36.

Figure 3:
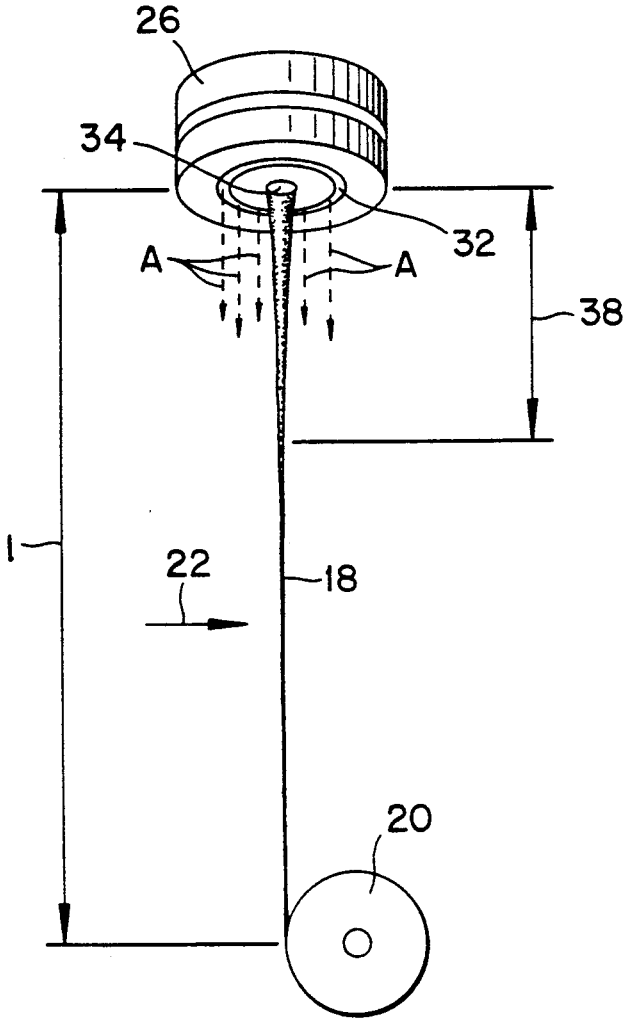
FIG. 3 is a schematic representation of an embodiment of the present invention wherein drawing of the as-spun melt-extruded filamentary material is accomplished aerodynamically following extrusion through a bicomponent extrusion nozzle comprising a core nozzle for the polymeric material and a jacket nozzle for the stream of heated air.

A practical embodiment of the process of the invention is shown in the embodiment of the spinning device according to FIG. 3. Directly at the exit from a bi-component nozzle 26 functioning as a spinning nozzle, the extruded microfilament 18 is embedded in a warm air stream indicated by arrows A. This warm air stream A accompanies the microfilament substantially within the stretching area 38, which represents the main stretching area with a length of about 30 to 50 cm. The total distance 1 between bi-component nozzle 26 and roll 20 is about 1 m.

Underneath stretching area 38, cooling air 22 is transversely blown against microfilament 18, as in FIG. 1 and 2. Due to the provision of the warm air stream A, whose temperature should not exceed or fall below the temperature of the molten material of 280° C. at the exit through spinning aperture 14 by ±10° C., an excessively quick cooling of microfilament 18 is prevented. Rather, in the invention cooling of microfilament 18 is delayed and takes place continuously.

Due to the fact that cooling takes place not suddenly but continuously, the danger is avoided that on the surface area of microfilament 18 an undercooled skin forms which results in filament breakage.

In addition, the invention makes sure that despite a decrease of the diameter of microfilament 18, the usual drawing speed of 4000–6000 m/min can be utilized, so that the economy of a spinning device is not lost when smaller diameters of the microfilaments are desired.

Figure 4:
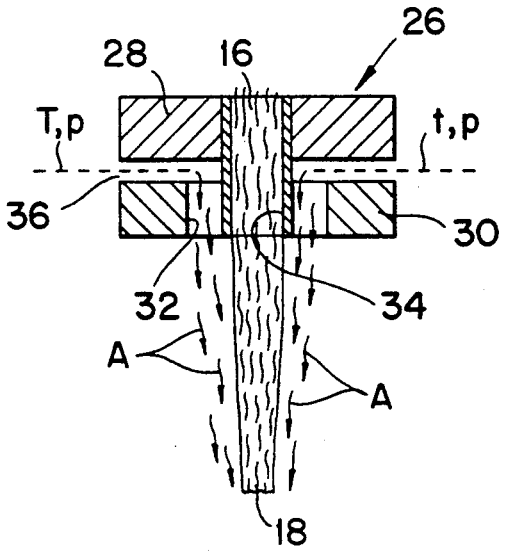
FIG. 4 is a more detailed showing of the bicomponent extrusion nozzle utilized in FIG. 3.

For producing the hot air stream A, which is decisive in the invention, bi-component nozzle 26, shown more clearly in FIG. 4, can be used which has a core nozzle 28 as well as a jacket nozzle 30 and also has a ring slot 32. Ring slot 32 annularly surrounds spinning aperture 34 from which the molten material exits.

While during the known use of bi-component nozzle 26 molten material is exuded through spinning aperture 34 of core nozzle 28 as well as through ring slot 32 of jacket nozzle 30, it is proposed according to FIG. 4 that molten material exclusively exits through inner core nozzle 28. On the other hand, the hot air stream is supplied or produced under pressure p and temperature T through ring slot 36, which hot air stream then envelops microfilament 18 like a jacket.

Of course, the invention can be utilized by using bi-component nozzle 26 also for the production of spun bond fabric in a spinning device according to FIG. 2.

By using the inventive process or the new spinning device, microfilament yarns with a super fine single titer of 0.33 dtex can be produced without losing the economy of a spinning arrangement, so that the production of textiles is possible which practically are equal to natural silk.

We claim:

1. In a process for producing microfilaments that are useful in the production of textile or spun bond fabrics having a silk-like character comprising:

(a) melt extruding a molten melt-spinnable polymeric material downwardly through a plurality extrusion orifices, (b) passing the resulting molten melt-spinnable polymeric material in the direction of its length through a solidification zone having an entrance end and an exit end wherein cooling air is transversely blown in contact with said molten polymeric material and it is transformed into a solidified microfilamentary material of less than 1 dtex per filament, and (c) exerting a pulling force on said solidified microfilamentary material after it leaves the exit end of said solidification zone so as to accomplish substantial drawing of said molten melt-spinnable polymeric material intermediate said extrusion orifices and its transformation into a microfilamentary material of less than 1 dtex per filament;

the improvement comprising surrounding said resulting molten melt-spinnable polymeric material as it passes from said extrusion orifices to the entrance end of said solidification zone with a protective stream of heated air that flows parallel to the direction of movement of said molten polymeric material and blowing said cooling air transversely in contact with said molten polymeric material in step (b) at a distance of at least approximately 100 mm, below said extrusion orifices.

2. An improved process for producing microfilaments according to claim 1 wherein said stream of heated air that flows parallel to the direction of movement of said molten polymeric material is supplied under pressure at a temperature that approximately corresponds to the temperature of said molten polymeric material.

3. An improved process for producing microfilaments according to claim 1 wherein said stream of heated air that flows parallel to the direction of movement of said molten polymeric material is supplied under pressure at a temperature that is within approximately ±10° C. of the temperature of said molten material.

4. An improved process for producing microfilaments according to claim 1 wherein said cooling air of said solidification zone is transversely blown in contact with said molten polymeric material in step (b) at a distance of approximately 500 mm. below said extrusion orifices.

5. An improved process for producing microfilaments according to claim 1 which includes the additional step (d) following step (c) of twisting said microfilaments to form a multifilamentary yarn.

6. An improved process for producing microfilaments according to claim 1 which includes the additional step (d) following step (c) of depositing said microfilaments as a spun bond fabric.

7. An improved process for producing microfilaments according to claim 1 wherein the pulling force of said drawing step (c) is accomplished by winding on a roll.

8. An improved process for producing microfilaments according to claim 1 wherein the pulling force of said drawing of step (c) is accomplished aerodynamically.

9. An improved process for producing microfilaments according to claim 1 wherein the resulting microfilamentary material as drawn in step (c) is a product of approximately 0.33 dtex per filament.

10. An improved process for producing microfilaments according to claim 1 wherein the resulting microfilamentary product following step (c) is collected at a rate of approximately 4,000 to 6,000 meters per minute.

* * * * *